United States Patent [19]

Simo

[11] 4,381,866

[45] May 3, 1983

[54] ARROWHEAD WITH REMOVABLE BLADES

[76] Inventor: Miroslav A. Simo, 370 N. Delaplaine Rd., Riverside, Ill. 60546

[21] Appl. No.: 364,499

[22] Filed: Apr. 1, 1982

[51] Int. Cl.[3] ..... F41B 5/02

[52] U.S. Cl. ..... 273/422; 30/337

[58] Field of Search ..... 273/422; 30/337

[56] References Cited

U.S. PATENT DOCUMENTS

| | | | |
|---|---|---|---|
| 2,940,758 | 6/1960 | Richter | 273/422 |
| 3,741,542 | 6/1973 | Karbo | 273/422 |
| 3,910,579 | 10/1975 | Sprandel | 273/422 |
| 4,036,499 | 7/1977 | Sherwin | 273/422 |
| 4,146,226 | 3/1979 | Sorensen | 273/422 |
| 4,210,330 | 7/1980 | Kosbab | 273/422 |
| 4,341,391 | 7/1982 | Anderson | 273/422 |

OTHER PUBLICATIONS

Archers Bible, 1966–1967, 3–1967, p. 76, Bod-Kin Model "D".

*Primary Examiner*—Paul E. Shapiro

*Attorney, Agent, or Firm*—Thomas W. Speckman

[57] ABSTRACT

An arrowhead assembly with removable blades for attachment to the forward end of an arrow shaft for archery shooting is disclosed which provides self-aligning and self-centering of the arrowhead upon the arrow shaft. The self-aligning and self-centering is achieved by a non-deformable blade locking ring fitting over a portion of a blade carrying body, the locking ring having an undercut forward portion fitting loosely over a rearward extension of each of the blades and the rearward end of the undercut having an acute angle for forcible engagement against an angle at the rear end of each blade rearward extension. A compressible, resilient ring fits over the blade carrying body adjacent the rearward side of the non-deformable blade locking ring. A mating bevel on the blade carrying body is positioned to engage an arrow shaft insert receiving cylinder chamfer whereby upon tightening the arrowhead assembly upon the arrow shaft, the compressible ring is compressed and uneven forces by the compressible ring are accommodated by canting of the non-deformable blade locking ring thereby providing solid engagement of the mating bevel and the chamfer while tightly holding the removable blades in position.

28 Claims, 2 Drawing Figures

ARROWHEAD WITH REMOVABLE BLADES

BACKGROUND OF THE INVENTION

1. Field of the Invention

This invention relates to an arrowhead having removable blades which is useful for hunting and provides for the safe exchange of blades in the arrowhead body.

2. Description of the Prior Art

Hunting arrowheads having sharpened blades fixed in a blade-carrying body are exemplified by U.S. Pat. Nos. 4,006,901; 4,093,230; 4,175,749; and 4,203,601.

It is frequently desirable to replace knicked or otherwise damaged blades without replacing an entire arrowhead. Some prior attempts to provide arrowheads with removable blades have involved fitting the blades directly onto the forward end of the arrow shaft itself as exemplified by U.S. Pat. No. 3,854,723; others wherein the blades form the point of the arrowhead itself are exemplified by U.S. Pat. No. 3,741,542; other attempts have provided retaining rings which fit through holes in the blades as exemplified by U.S. Pat. No. 3,756,600; or slots in the blades as exemplified by U.S. Pat. No. 3,915,455.

Other attempts have involved retaining individual blades in slots of blade holding bodies as exemplified by U.S. Pat. Nos. 2,940,758; 4,036,449; and 4,210,330. The 2,940,758 patent teaches solid radially extending blades having rectangular lips extending forwardly and rearwardly at the bottom edge of both ends of the blade to be covered by a removable tip at the forward end and a cylindrical ferrule at the rearward end. The blades are retained in the slots by the hollow portion of the tip and the hollow portion of the cylindrical ferrule overlapping the extending rectangular lips of the blades. One disadvantage of the arrowhead taught by the U.S. Pat. No. 2,940,758 is weakness and failure of the blade at one of the extending lips allowing the blade to fall out or become displaced in the slot. The U.S. Pat. No. 4,036,499 teaches solid radially extending blades fitting within slots in a blade carrying body wherein the rearward end of the blade is tapered to fit the tapered front undercut of a rear ferrule and the forward end of the blade tapered to fit a rear tapered section of a removable tip, the blade tapers corresponding to and aligned with tapers on the front and rear of the blade carrying body. The tips of the blades do not extend beyond the blade carrying body at either end. The tip and blade carrying body are assembled with the blades in the slot and the rear ferrule is screwed into position, the tapered front undercut of the rear ferrule mating with the tapered rear end of the blade carrying body. One disadvantage of the arrowhead of the U.S. Pat. No. 4,036,499 is the precision necessary in all components to hold each blade in place without movement. The U.S. Pat. No. 4,210,330 teaches solid blades mounted in offset slots parallel to tangents to the shaft. The blades may be held in place by bending the front of the blade over the blade carrying body when the tip is tightened and at their rearward end by a deformable collar urged into notches in each blade by screwing the rear end of the blade carrying body into the front socket of an arrow shaft. A resilient locking washer may be placed between the deformable collar and the end of the arrow shaft permitting adjusting the blades with respect to the nock at the rear of the arrow shaft. One disadvantage of the arrowhead of the U.S. Pat. No. 4,210,330 is that when one or more blades are unequal in length because of dirt under the V-shaped groove at the base of the tip or due to the blade stamping operation itself, the head becomes canted as it is tightened onto the arrow shaft causing it to act as a rudder causing erratic arrow flight. Also, the deformable collar becomes further deformed upon shooting impacts and the blades become loosened.

SUMMARY OF THE INVENTION

This invention relates to an arrowhead assembly with removable blades for attachment to the forward end of an arrow shaft for archery shooting. The arrowhead assembly has a body of generally circular cross section having a forward end and a rearward end. A generally pointed nose extends forwardly from the body or may be a separate piece attachable to the forward end of the body. The rearward end of the body has fastening means for securement to the forward end of the arrow shaft. The fastening means is generally a threaded shaft which mates with the inner threads of a conventional shaft insert at the front end of the arrow shaft. The body has a shoulder portion at the forward end of the fastening means, the transition between the shaft portion and the shoulder portion preferably being angled to mate with the bevel angle at the forward end of the shaft insert. The body has multiple radial slots along its long axis for receiving the removable blades, the slots terminating in an acute angle stop at their forward end in the region of the nose and extending into the shoulder portion at their rearward end. A non-deformable blade locking ring fits over the shoulder portion of the body, the locking ring having an undercut forward portion which spaces the forward portion of the ring from the shoulder, the rearward end of the undercut forming an angle to a diameter of the ring. A compressible, resilient ring fits over the shoulder of the body adjacent the rearward side of the locking ring and adjacent the forward end of the arrow shaft, the compressible ring being in compressed condition when the arrowhead assembly is installed on the arrow shaft. The blades have a shape exterior to the arrowhead body adapted for good aerodynamic flight characteristics, deep target penetration and minimum noise in flight. The blades have an acute angle at their forward ends to mate against the acute angle stop at the forward end of the slot for receiving the blade and have an extension at their rearward ends to mate within the non-deformable locking ring undercut portion and against the angle at the rearward end of that undercut. The arrowhead assembly of this invention is suitable for carrying 2 to 7 blades, 3 to 5 blades being preferred. The blades may have multiple cutouts designed to minimize wind noise and erratic flight.

The arrowhead of a preferred embodiment of this invention is self-aligning and self-centering as it is tightened onto the arrow shaft. This is accomplished by seating the body against the bevel on the forward end of the arrow shaft insert. As pointed out above, the transition between the shoulder portion of the body and the shaft portion is angled to mate with the bevel angle at the forward end of the arrow shaft insert. Uneven length blades, or dirt under the front acute angle stop for the blades will not force the head into a canted attitude as the head is tightened on the shaft since the blade locking ring may become canted due to the compressibility of the compressible ring. The self-aligning and self-centering blades of the arrowhead assembly of this invention provide straight shooting broad arrowheads having removable blades which may have cutout sections. The self-aligning and self-centering arrowhead assemblies of this invention also make it possible to provide arrowheads having blades extending up to 2 inches in diameter.

Accordingly, one object of this invention is to provide an arrowhead with removable blades which is self-aligning.

Another object of this invention is to provide an arrowhead with removable blades which is self-aligning and self-centering.

Yet another object of this invention is to provide an arrowhead with removable blades which may be substantially assembled and the blades held in place prior to being attached to the arrow shaft.

It is still another object of this invention to provide an arrowhead assembly having blades with multiple cutouts.

Still another object of this invention is to provide self-aligning and self-centering arrowhead assemblies to enable straight shooting of arrowheads having blades extending up to about 2 inches in diameter.

BRIEF DESCRIPTION OF THE DRAWING

The above objects and other objects and advantages of the invention will become more apparent from disclosure of preferred embodiments and reference to the drawings wherein.

DESCRIPTION OF PREFERRED EMBODIMENTS

Figure 1:
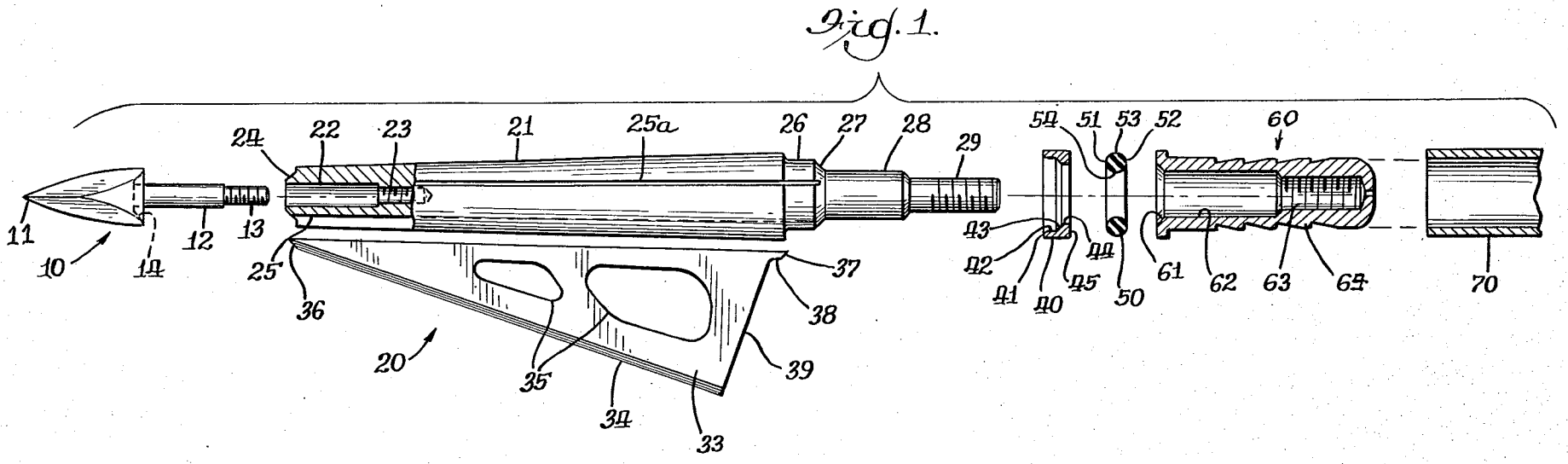
FIG. 1 shows an unassembled partially sectioned side view of an arrowhead assembly according to one embodiment of this invention.

Referring to the figures, an arrowhead assembly with removable blades according to one embodiment of this invention is shown with a detachable pointed nose portion 10, blade carrying body portion 20, blade locking ring 40, and compressible ring 50 for attachment to the forward end of arrow shaft 70 by screwing into insert 60 at the forward end of the arrow shaft.

Blade carrying body portion 20 is of generally circular cross section shape, such terminology also including polygonal shapes, especially those which may have as many sides as the number of blades carried by the body portion 20. For example, the blades may be inserted into slots located at angles of a polygon to obtain deeper depth for the blade carrying slots 25 or the blades may be located in the central portion of flats between the angles of the polygonal cross-sectional shape to obtain better penetration of the target material. It is preferred that the cross-sectional shape of blade carrying body portion 20 be circular, at least at its rearward portion, in order to fair into the shape of arrow shaft 70. A generally pointed nose portion 10 extends from the forward end of blade carrying body 20. As shown in the figures, nose portion 10 is a separate piece which is attached by threads 13 mating with receiving threads 23 for attachment of the nose portion to the blade carrying body. However, the generally pointed nose portion 10 may be non-removably attached to blade carrying body 20 by any means known to the art. Removal of the arrowhead tip or pointed nose portion 10 is not necessary to the function of removing blades from and inserting blades into blade carrying body portion 20. As shown in the figures as a separate component, the pointed nose portion 10 has generally pointed end 11 with its width increasing rearwardly toward extending shaft portion 12 and threaded shaft portion 13 for snug attachment to and fairing with blade carrying body portion 20. Nose portion 10 may have a conical point 11 upon which serrations may be provided toward the larger end as shown in FIG. 1 of my U.S. Pat. No. 4,090,230 or nose portion 10 may have a tapered point of polygonal cross section having flats 15 as shown in FIG. 1 hereof. Three to 8 flats becoming round both at point 11 and at its rearward cross section adjacent the forward end of blade carrying body 20 are preferred. Point 11 may be sharpened and of a hardened material, such as steel, to facilitate deeper penetration upon striking an object or may be slightly blunt to prevent curling upon striking a hard object. The rearward side of pointed nose portion 10 has undercut portion 14, the undercut portion angle is suitably made at about 30° to about 70° with the axis of the arrow and preferably about 40° to about 50° with the axis of the arrow.

The forward end of blade carrying body portion 20 has tapered mating surface 24 for snugly mating with undercut 14 of pointed nose 10. The rearward end of blade carrying body portion 20 has fastening means shaft 28 and threaded shaft 29 mating with receiving cylinder 62 and internal threads 63 of insert 60 at the forward end of arrow shaft 70. Any suitable fastening means may be used for securement of blade carrying body portion 20 to shaft 70. For example, bayonet or O-ring and groove fastening means may be used. The terminology "fastening means" is meant to include all appropriate fastening methods. Arrow shaft inserts such as insert 60 are commonly used in conjunction with attachment of heads to arrow shafts and any type of such insert may be used. Most inserts have a chamfer at their open end, such as chamfer 61. The inserts are normally retained within the arrow shaft 70 by friction means shown as friction arms 64. Arrowhead body 20 has shoulder portion 26 at the forward end of the fastening means, the rearward end of shoulder 26 having bevel 27 for mating with chamfer 61 at the forward end of insert 60. Generally the bevel portion for mating wih and the chamfer portion form an angle of about 30° to about 70° to the axis of the arrow, about 40° to about 50° being preferred. The central portion 21 of blade carrying body portion 20 has multiple radial slots 25 along its long axis for receiving removable blades 33. The radial slots terminate at their forward end in an acute angle stop which is formed by undercut 14 in arrowhead tip 10. The blade carrying slots 25, **25*a*, etc., extend into shoulder portion 26 at their rearward end and may extend rearwardly to provide open slots through insert mating bevel 27**.

Figure 2:
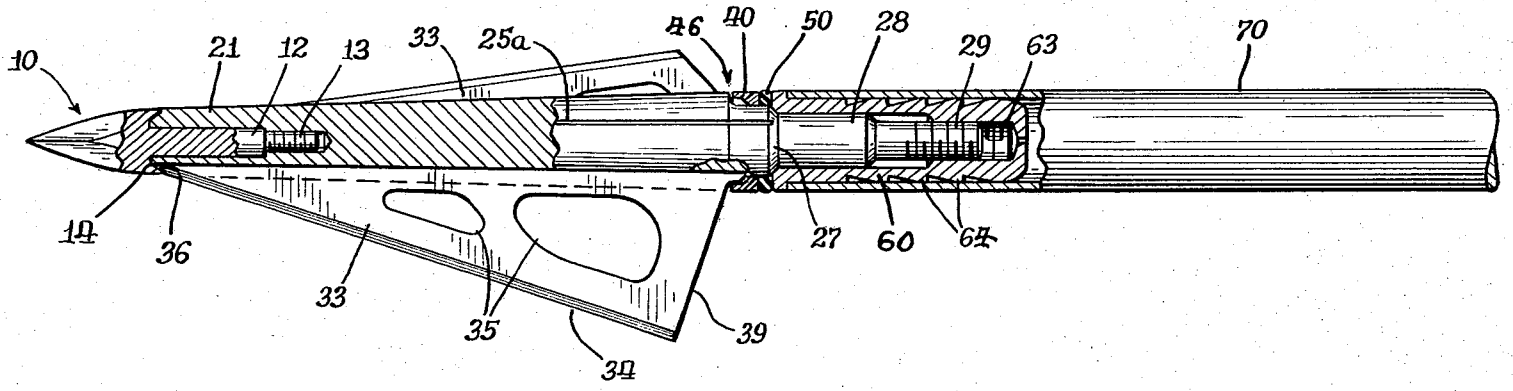
FIG. 2 shows in a partially sectioned side view the assembled arrowhead shown in FIG. 1.

Non-deformable blade locking ring 40 fits over shoulder portion 26 of blade carrying body 20. Locking ring 40 has undercut forward portion 42 which spaces the forward portion of ring 40 outwardly from shoulder 26. The rearward end of undercut portion 42 forms angular portion 43 which is at an acute angle to the axis of ring 40. The surface of angular portion 43 mates with ring mating bevel 37 on the rearward end of blade 33. Undercut portion 42 fits over ring engagement extension 38 of blade 33. Forward side 41 of non-deformable blade locking ring 40, when in blade holding position, is spaced rearwardly from the forward end of shoulder portion 26. Thus, there is a space 46, as shown in FIG. 2, between forward side 41 of blade locking ring 40 and the central portion 21 of blade carrying body 20. The outer surface of blade locking ring 40 is preferably sized and shaped to fair into central portion 21 of blade carrying body 20 and arrow shaft 70 in a streamlined fashion.

Compressible ring 50 has inner surface 54 which fits snugly over the surface of shoulder 26. Forward surface 51 of compressible ring 50 is adjacent rearward surface 45 of blade locking ring 40 and rearward surface 52 is adjacent the forward surface of insert 60. It is preferred that when compressible ring 50 is in compressed condition, outer surface 53 is about the same diameter as the diameter of arrow shaft 70 or non-deformable blade holding ring 40. Compressible ring 50 may be made of any suitably compressible and resilient material such as natural or synthetic rubber and resilient polymers such as propylene, neoprene and butyl. It is preferred that blades 33 may be placed in their slots, blade locking ring 40 be placed in position and compressible ring 50 placed in position over shoulder 26 and the arrowhead assembly maintained in assembled position prior to being fastened to arrow shaft 70. Another means of assembly is that shaft 29 may be partially screwed into threads 63 with blade locking ring 40 and compressible ring 50 slid rearwardly of shoulder 26, blades 33 placed in their slots and tightening of the arrowhead assembly into arrow shaft insert 60 forces blade locking ring 40 and compressible ring 50 forwardly into place.

Blades 33 may have any shape exterior to arrowhead blade carrying body 20 adapted for good aerodynamic flight characteristics and deep target penetration. The blades have an acute angle 36 at their forward ends to mate against the acute angle stop 14 at the forward end of blade carrying slots 25. Each blade has an extension at its rearward end to mate within the non-deformable locking ring 40. The rearward extending portion 38 mates loosely with blade locking ring undercut portion 42 to allow sliding and canting of blade locking ring 40 and ring mating bevel 37 mates with bevel 43 in blade locking ring 40. The action of ring mating bevel 37 mating forcibly with bevel 37 on blade rearward extending portion 38 causes two force components on the blade: one forward force forcing the front of the blade against the acute angle stop at the forward end of the blade carrying slot; and a second downward force forcing the blade against the bottom of the slot. The outer edge of the blades may be of any desired shape having straight, concave or convex leading edges which may be sharpened to form cutting edge 34. Trailing edge 39 may be of any desired shape, it is preferred the trailing edges not have a barb, but provide easy withdrawal from a target. In a preferred embodiment, the blades have one or more cutouts to reduce steering. Multiple cutouts are preferred to be located as far from the arrow centerline to most reduce steering effects of the blades. Cutouts may be of any suitable shape and size as long as the compressive strength and resistance to bending of the blade is maintained. The arrowhead assembly according to this invention may be provided with 2 to 7 blades, 3 to 5 blades being preferred.

Referring particularly to FIG. 2, it is seen that as the arrowhead assembly of this invention is assembled and attached to the forward end of an arrow shaft that the blades are held snugly in place by the acute angle 36 at their forward ends mating against acute angle stop 14 and by ring engagement extension 38 at their rearward ends fitting loosely within ring undercut 42 and ring bevel 43 forcibly engaging ring mating bevel 37. The arrowhead assembly of this invention is self-aligning and self-centering by utilization of blade locking ring 40 and compressible ring 50 in the above described fashion and especially when the forward side 41 of blade locking ring 40 does not engage body portion 21 nor the trailing edge 39 of blade 33. The desired positioning and retention of the blades is achieved by bevel 43 of the blade locking ring 40 forcibly engaging ring mating bevel 37 in a manner allowing canting of blade locking ring 40. If the replaceable blades are somewhat different in length, this is accommodated by compressible ring 50 and a slight canting of non-deformable blade locking ring 40 due to the space 46 allowing such a cant. Self-aligning and self-centering of the arrowhead with respect to the arrow shaft is achieved by bevel 27 seating in chamfer 61 with any variation in the blades being accommodated by compressible ring 50 and canting of non-deformable blade locking ring 40. While chamfer 61 is shown in the figures and is preferably located at the open end of receiving cylinder 62, it is apparent that chamfer 61 may be located at any location in receiving cylinder 62 of insert 60. The more the arrowhead of this invention is tightened onto the arrow shaft, the more aligned and centered it becomes. As a result of the self-aligning and self-centering feature of this invention, wider removable-type blades may be used than any presently known to the inventor. According to the present invention, blades providing an arrowhead diameter of up to $1\frac{3}{4}$ inch to 2 inches may be used without obtaining undesired steering effects.

The components of the arrowhead of this invention may be fabricated from any suitable materials. It is preferred that the pointed nose portion be fabricated from hardened steel. In order to minimize weight of the arrowhead assembly, it is preferred that the blade carrying body be fabricated from aluminum, titanium, magnesium and alloys or other lightweight metal alloys. The body portion and the non-deformable blade locking ring may also be suitably fabricated from high impact-resistant molded materials, such as synthetic polymeric materials such as nylon, polyethylene, polystyrene, polycarbonate, polyacetal, polysulfone, polyphenaleneoxide, polyesters and the like. The synthetic polymeric materials may be reinforced by any method known to the art, such as incorporation of fibers, such as fiberglass. Also suitable for the pointed nose portion, the blade carrying body and the non-deformable blade locking ring are moldable metals or metals suitable for forming into moldable shapes by powdered metallurgical processes such as aluminum, titanium, magnesium and their alloys or other lightweight metals or alloys. The non-deformable blade locking ring may be fabricated from steel for strength, or any of the materials suggested for the blade carrying body as long as they provide sufficient strength and do not deform in use. The materials of construction may be selected so that the arrow and arrowhead assembly have a similar weight distribution as a target arrow and thus, the shooter does not have to allow for different arrow trajectory when he switches from target points to the arrowhead of this invention.

As can be readily seen from the above description, a wide variety of blade carrying bodies having different configurations and number of blades may be interchanged using the same arrow shaft and different shapes of blades may be interchanged in the blade carrying body of the arrowhead assembly of this invention. Thus, the different arrowhead bodies and blades may be marketed separately for interchange on the arrow shaft.

A plastic sheath may be fabricated to cover the exposed blade portions when handling or storing the arrowhead assembly and when attaching the arrowhead assembly to the forward end of an arrow shaft. A suitable sheath of semi-rigid plastic is taught by my U.S. Pat. No. 4,090,230 and is satisfactory for use with the arrowhead assemblies of this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrowhead assembly with removable blades for attachment to the forward end of an arrow shaft comprising:

a body of generally circular cross section having a forward end and a rearward end, a generally pointed nose extending from said forward end and said rearward end having fastening means for securement to said forward end of an arrow shaft, said body having a shoulder portion at the forward end of said fastening means, said body having multiple radial slots along its long axis for receiving said removable blades, said slots terminating in an acute angle stop at their forward end in the region of said nose and extending into said shoulder portion at their rearward end;

a non-deformable blade locking ring fitting over said shoulder portion of said body, said locking ring having an undercut forward portion spacing the forward portion of said ring outwardly from said shoulder, the rearward end of said undercut forming an acute angle to the axis of said ring;

a compressible ring fitting over said shoulder of said body adjacent the rearward side of said locking ring and adjacent the forward end of said arrow shaft, said compressible ring being in compressed condition when said arrowhead assembly is installed on said arrow shaft; and multiple blades having a shape exterior to said arrowhead body adapted for good aerodynamic flight characteristics and deep target penetration, said blades having an acute angle at their forward ends to mate against said acute angle stop and having an extension at their rearward ends to mate within said non-deformable locking ring undercut portion and an acute angled end to mate against said angle at the rearward end of said undercut.

2. The arrowhead assembly of claim 1 having 2 to 7 said blades.

3. The arrowhead assembly of claim 1 having 3 to 5 said blades.

4. The arrowhead assembly of claim 1 wherein said pointed nose is a separate piece fastened to the forward end of said body, said acute angle stop comprising the rearward end of said separate pointed nose.

5. The arrowhead assembly of claim 1 wherein said acute angle of said stop and blade forward end is about 30° to about 70° to the axis of the arrowhead.

6. The arrowhead assembly of claim 1 wherein said acute angle of said stop and blade forward end is about 40° to about 50° to the axis of the arrowhead.

7. The arrowhead assembly of claim 1 wherein said angle of said rearward end of said undercut and said blade extension acute angled end is about 30° to about 70° to the axis of the arrowhead.

8. The arrowhead assembly of claim 1 wherein said angle of said rearward end of said undercut and said blade extension acute angled end is about 40° to about 50° to the axis of the arrowhead.

9. The arrowhead assembly of claim 1 wherein the forward side of said non-deformable blade locking ring is spaced rearwardly from the forward end of said shoulder portion and the trailing edge of said blades.

10. The arrowhead assembly of claim 9 wherein said undercut portion of said non-deformable blade locking ring is spaced outwardly from said blade extensions at the rearward ends of said blades.

11. The arrowhead assembly of claim 1 wherein said fastening means at the rearward end of said body comprises a threaded shaft portion mating with internal threads of an insert in said forward end of said arrow shaft.

12. The arrowhead assembly of claim 11 wherein the rearward end of said shoulder comprises an angular portion for mating with a chamfer at the forward end of said insert.

13. The arrowhead assembly of claim 12 wherein said angular portion and said chamfer forms an angle of about 30° to about 70° to the axis of said arrow.

14. The arrowhead assembly of claim 12 wherein said angular portion and said chamfer forms an angle of about 40° to about 50° to the axis of said arrow.

15. The arrowhead assembly of claim 1 wherein said compressible ring in said compressed condition has an outer diameter about the same as the diameter of said arrow shaft and said non-deformable ring.

16. The arrowhead assembly of claim 1 wherein said compressible ring is made of a material selected from the group consisting of rubber and resilient synthetic polymers.

17. The arrowhead assembly of claim 1 wherein said blades comprise metal sheets having sharpened leading edges and at least one cutout portion.

18. The arrowhead assembly of claim 17 wherein said blades have multiple cut out portions in the area of the blade exterior to said body.

19. The arrowhead assembly of claim 1 wherein said blades have an extreme outside diameter of about 1 to about 2 inches.

20. The arrowhead assembly of claim 1 wherein said blades have an extreme outside diameter of about 1½ to about 2 inches.

21. The arrowhead assembly of claim 1 wherein said acute angle of said stop and blade forward end is about 30° to about 70° to the axis of the arrowhead; said angle of said rearward end of said undercut and said blade extension acute angled end is about 30° to about 70° to the axis of the arrowhead; the forward side of said non-deformable blade locking ring is spaced rearwardly from the forward end of said shoulder portion and the trailing edge of said blades and said undercut portion of said non-deformable blade locking ring is spaced outwardly from said blade extensions at the rearward ends of said blades; and the rearward end of said shoulder comprises an angular portion for mating with a chamfer in said insert and said angular portion and said chamfer forms an angle of about 30° to about 70° to the axis of said arrow.

22. In a self-aligning and self-centering arrowhead assembly having removable blades fitting in radial slots along the long axis of a blade carrying body and attached to an arrow shaft insert having a chamfer within a receiving cylinder, a self-aligning, self-centering means comprising:

a non-deformable blade locking ring fitting over a portion of said blade carrying body, said locking ring having an undercut forward portion fitting loosely over a rearward extension of each of said blades, the rearward end of said undercut having an acute angle for forcible engagement against an angle at the rear end of said blade rearward extension;

a compressible, resilient ring fitting over said blade carrying body adjacent the rearward side of said non-deformable blade locking ring;

a mating bevel on said blade carrying body positioned to engage said arrow shaft insert receiving cylinder chamfer and compressing said compressible ring upon such engagement whereby uneven forces by compressible ring are accommodated by canting of said non-deformable blade locking ring thereby providing solid engagement of said mating bevel and said chamfer.

23. In the arrowhead assembly of claim 22 wherein said angle of said rearward end of said undercut and said blade extension acute angled end is about 30° to about 70° to the axis of the arrowhead.

24. In the arrowhead assembly of claim 22 wherein said angle of said rearward end of said undercut and said blade extension acute angled end is about 40° to about 50° to the axis of the arrowhead.

25. In the arrowhead assembly of claim 22 wherein the forward side of said non-deformable blade locking ring is spaced rearwardly from any outwardly extending shoulder portion and the trailing edge of said blades.

26. In the arrowhead assembly of claim 25 wherein said undercut portion of said non-deformable blade locking ring is spaced outwardly from said blade extensions at the rearward ends of said blades.

27. In the arrowhead assembly of claim 22 wherein said mating bevel and said chamfer forms an angle of about 30° to about 70° to the axis of said arrow.

28. In the arrowhead assembly of claim 27 wherein said mating bevel and said chamfer forms an angle of about 40° to about 50° to the axis of said arrow.

* * * * *